US006644649B1

(12) United States Patent
Chaume et al.

(10) Patent No.: US 6,644,649 B1
(45) Date of Patent: Nov. 11, 2003

(54) DESTACKING DEVICE WITH THICKNESS BASED FEEDBACK CONTROL

(75) Inventors: Francois Chaume, Saint Marcel les Valence (FR); Fabrice Darrou, La Farlede (FR); Jean-Marc Teluob, Cornas (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 10/069,244

(22) PCT Filed: Aug. 22, 2000

(86) PCT No.: PCT/EP00/08199

§ 371 (c)(1),
(2), (4) Date: Jun. 18, 2002

(87) PCT Pub. No.: WO01/14228

PCT Pub. Date: Mar. 1, 2001

(30) Foreign Application Priority Data

Aug. 25, 1999 (FR) ..... 99 10770

(51) Int. Cl.[7] ..... B65H 1/18

(52) U.S. Cl. ..... 271/152; 271/148; 271/149; 271/153

(58) Field of Search ..... 271/148, 149, 271/152, 155, 153; 414/798.9; 73/1.15, 790

(56) References Cited

U.S. PATENT DOCUMENTS

| | | | | | |
|---|---|---|---|---|---|
| 5,957,448 | A | * | 9/1999 | Frank et al. | 271/152 |
| 5,971,391 | A | * | 10/1999 | Salomon et al. | 271/153 |
| 6,032,946 | A | * | 3/2000 | Marshall et al. | 271/152 |
| 6,123,330 | A | * | 9/2000 | Schaal | 271/31 |
| 6,217,020 | B1 | * | 4/2001 | Supron et al. | 271/149 |
| 6,270,070 | B1 | * | 8/2001 | Salomon et al. | 271/111 |
| 6,318,185 | B1 | * | 11/2001 | Aumard et al. | 73/818 |

* cited by examiner

*Primary Examiner*—Donald P. Walsh
*Assistant Examiner*—Kaitlin Joerger
(74) *Attorney, Agent, or Firm*—Pitney, Hardin, Kipp & Szuch LLP

(57) ABSTRACT

A device (1) for removing flat objects from a stack includes a magazine (2), in which flat objects are stacked on edge to be serialized, and a vertical destacking plate (6) disposed directly in front of the magazine (2) and against which the first object (O1) of the stack is pressed. The first object (O1) of the stack is ejected in a direction (E) perpendicular to the direction of advance (D) of the stack of flat objects in the magazine (2). The device (1) also includes means (14,15) for measuring the thickness of each flat object pressed against the destacking plate (6). This thickness measurement serves as a feedback control for the movement of the stack of flat objects in the magazine (2). The device (1) may be used in a postal sorting machine.

4 Claims, 1 Drawing Sheet

DESTACKING DEVICE WITH THICKNESS BASED FEEDBACK CONTROL

BACKGROUND OF THE INVENTION

The invention relates to a device for removing flat objects from a stack comprising a magazine in which are stacked on edge flat objects to be serialized and a vertical destacking plate disposed directly in front of the magazine and against which the first object of the stack will be pressed, said first object of the stack being ejected in a direction perpendicular to the direction of advance of the stack of flat objects in the magazine.

The invention applies most particularly to a device for removing flat objects from a stack for a postal sorting machine operating in synchronous mode.

In contemporary destackers for postal sorting machines operating in synchronous mode, the stack of flat objects is pushed step by step toward the destacking plate only after the first object of the stack pressed against this destacking plate has been completely ejected from the destacker. The users of this type of sorting machine are seeking to be able to process an ever broader spectrum of flat objects, that is to say flat objects whose height, width and thickness dimensions vary greatly. When a very thick object is ejected from the destacker, an empty space is created between the destacking plate and the new first object of the stack to be serialized and the idea on which the invention is based is to fill this empty space as rapidly as possible so as to increase the destacking throughout.

The document DE-19545057C discloses a thickness measurement system for measuring the thickness of each flat object pressed against a destacking device, this thickness measurement serving for the feedback control of the movement of the stack of flat objects in the magazine. In this system, the thickness is found from the deflection of a swivel roller which deflection can be determined by a rotary potentiometer. Such system is not fitted to process a broader spectrum of flat objects.

BRIEF SUMMARY OF THE INVENTION

Accordingly, the present invention is a device for removing flat objects from a stack comprising a magazine, in which are stacked on edge flat objects to be serialized, a destacker device vertically disposed directly in front of the magazine and a motorized means for advancing the stack of flat objects along a longitudinal direction (D) in the magazine towards said destacker device so that the first object of the stack of flat objects is pressed against the destacker device in order to be ejected from the stack of flat objects in a direction perpendicular to the direction of advance of the stack of flat objects.

The device also comprises a thickness measurement means for measuring the thickness of each ejected object. The thickness measurement serves as a feedback control for the movement of the stack of flat objects in the magazine in such a way to bring forward the movement of the stack of flat objects toward the destacker device by a distance corresponding to the thickness measurement of the ejected object.

The thickness measurement means comprises at least one pair of elastically deformable wheels made of elastomer and between which is pinched each ejected object and a pair of laser telemeters mounted between said destacking device and the pair of elastically deformable wheels.

Each elastically deformable wheel has a fixed position rotation axle and comprises a hub joined to an annular tread strip by elastically deformable circular actuate veins. Each vein has its two ends for joining to the hub and to the annular strip of the wheel which are situated on a spoke of the wheel.

BRIEF DESCRIPTION OF THE DRAWING

The destacking device according to the invention is described hereinafter in detail herein below in conjunction with the single FIGURE which shows same very diagrammatically.

DETAILED DESCRIPTION OF THE INVENTION

Figure 1:
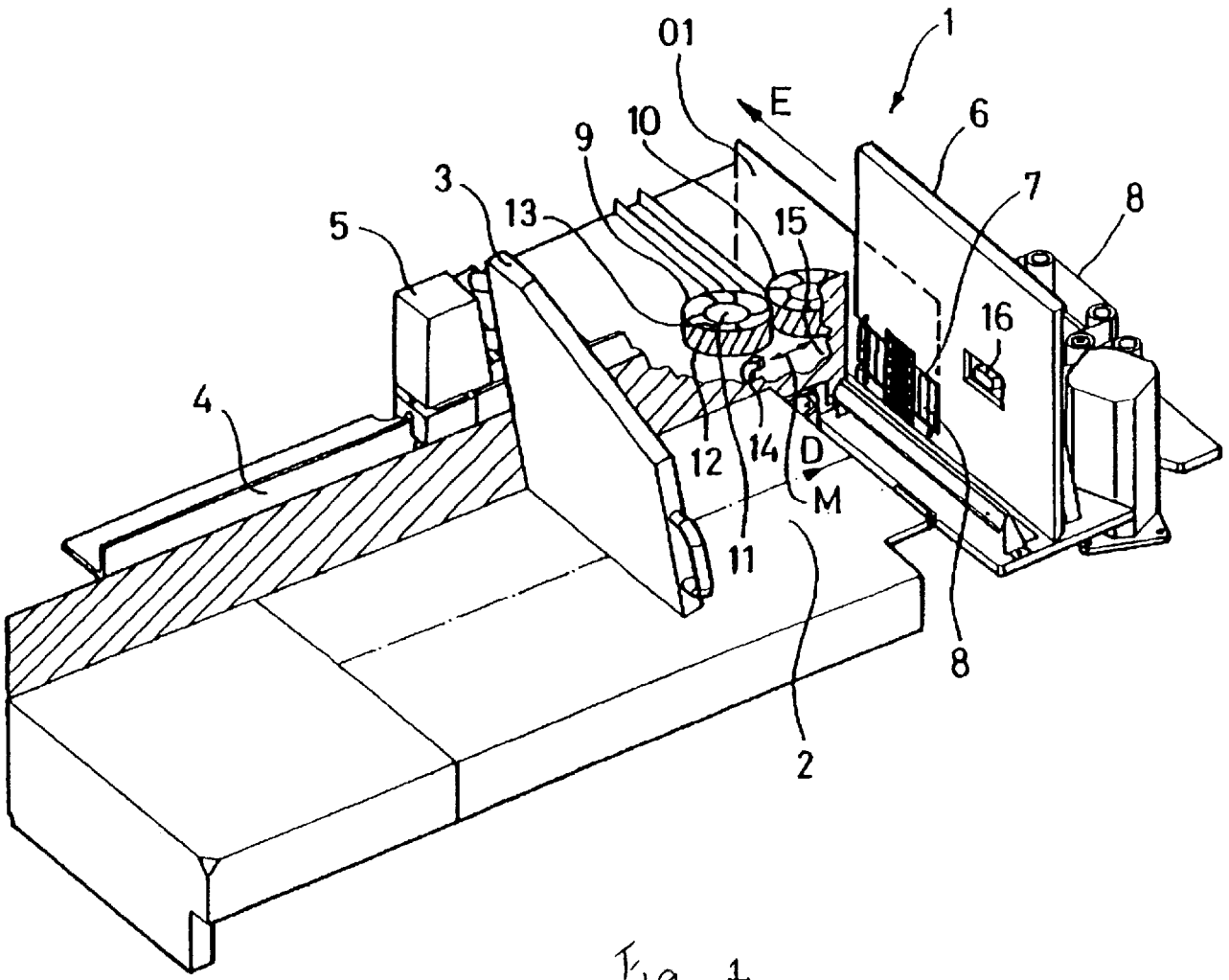

The device 1 for destacking flat objects, shown in the FIGURE, is intended to be mounted in a synchronous postal sorting machine.

It comprises a magazine 2 in which are stacked, on edge, flat objects to be serialized and a palette 3 intended to push the stack of flat objects on edge in a longitudinal direction D. The palette 3 is mounted movably along a rail 4 which extends in the direction D and the palette is moved in this direction by a stepper type motorization 5.

The destacking device 1 further comprises a vertical fixed destacking plate which extends in the direction E perpendicular to the direction D and along which is ejected each first object of the stack at the exit of the destacker.

As is visible in the FIGURE, the destacking plate 6 exhibits an opening 7 in the plane of which is moved, in the horizontal direction E, a perforated strip 8 which cooperates with a suction nozzle (not represented) mounted behind the perforated strip. When the stack of flat objects is pushed by the palette 3 toward the destacking plate 6, the first object such as O1 of the stack is applied hard against the destacking plate 6 and, under the combined effect of the suction force of the nozzle and of the motion of the perforated strip, it is ejected in the direction E at the exit of the destacker as illustrated by the arrow E.

In front of this destacking plate 6, on the exit side of the destacker, there is provided at least one pair of elastically deformable motorized elastomer wheels 9 and 10 between which the flat object ejected from the destacker 6 is pinched. These two motorized wheels 9 and 10 each have a fixed-position vertical rotation axle. Each wheel comprises a hub 11 joined to an annular tread strip 12 by elastically deformable circular arcuate veins 13, each vein having its two ends for joining to the hub and to the annular tread strip of the wheel which are situated on a spoke of the wheel.

These two wheels are mounted so as to take responsibility for the movement of the object O1 at the exit of the destacker also to press on these two faces so as to allow accurate measurement of the thickness of the flat object.

This thickness measurement is ensured by two laser telemeters 14 and 15 mounted between the wheels 9 and 10 and the destacking plate 6 on either side of the plane in which the first object of the stack is ejected at the exit of the destacker so that each laser telemeter measures the distance between a face of the flat object and a reference axis, for example the mid-axis parallel to the direction E and passing between the two wheels 9 and 10, as illustrated by the double arrow M.

The measurement signals delivered by the laser telemeters 14 and 15 are processed by an electronic computation unit (not represented) which feedback controls the motorization 5 of the palette 3 in such a way as to bring forward the movement of the stack of flat objects to be serialized toward the reference plate by a distance corresponding to the measured thickness of the first object of the stack and to do so even before this first object of the stack has been ejected from the destacker.

Furthermore, a system 16 for measuring the load applied by the stack of flat objects against the destacking plate 6 is provided so as to regulate the advance of the stack of flat objects in the magazine 2. This system 16 can be designed according to two different principles. It may firstly entail a system for detecting a force threshold comprising a pad illustrated in the FIGURE, which is disposed in an aperture of the plate 6 so as to be in contact with the stack of flat objects and which is mounted on an oscillating lever (not represented) disposed behind the plate 6. The flat objects advancing on the magazine will be pressed against this pad. The lever carrying the pad, returned into position by a calibrated spring, is equipped with a flag making it possible to blank off an optoelectronic cell if the flag passes through a predetermined position corresponding to a certain load applied to the pad. The blanking off of the cell is used to halt the movement of the stack of flat objects in the magazine. It is therefore understood that in this case the thickness measurement triggers the movement of the stack of flat objects in the magazine whilst the load measurement controls the stoppage of the movement of the stack of flat objects in the magazine.

According to a variant, the load measurement can be carried out with a strain gauge and in this case the pad is mounted on a strain gauge bar which delivers a continuous signal making it possible, in combination with the thickness measurement, to regulate the speed of movement of the stack of flat objects in the magazine, that is to say to slow down the movement of the stack of flat objects in tandem with an increase in the load measured by the system 16.

The arrangement of the destacker according to the invention thus helps to increase the rate of destacking of flat objects.

What is claimed is:

1. A device for removing flat objects from a stack comprising a magazine (2) in which are stacked on edge flat objects to be serialized, a destacker device (6,8) vertically disposed directly in front of the magazine and a motorized means (4) for advancing the stack of flat objects along a longitudinal direction (D) in the magazine towards said destacker device so that the first object (O1) of the stack of flat objects is pressed against said destacker device in order to be ejected from the stack of flat objects in a direction (E) perpendicular to said direction (D) of advance of the stack of flat objects, which furthermore comprises a thickness measurement means for measuring the thickness of each ejected object, said thickness measurement serving for the feedback control of the movement of the stack of flat objects in the magazine (2) in such a way to bring forward the movement of the stack of flat objects towards the destacker device by a distance corresponding to the measured thickness of said ejected object, characterized in that said thickness measurement means comprises at least one pair of elastically deformable wheels (9,10) made of elastomer and between which is pinched each ejected object and a pair of laser telemeters (14,15) mounted between said destacking device and said pair of elastically deformable wheels, and in that each elastically deformable wheels has a fixed position rotation axle and comprises a hub (11) joined to an annular tread strip (12) by elastically deformable circular arcuate veins (13), each vein having its two ends for joining to the hub and to the annular strip of the wheel which are situated on a spoke of the wheel.

2. The device according to claim 1, further comprising a load measurement means (16) for measuring the load applied by the stack of flat objects against the destacking device (6,8), this load measurement serving to regulate the movement of the stack of flat objects in the magazine (2).

3. The device according to claim 2, wherein said load measurement means (16) comprises a pad disposed in the destacker device (6,8) so as to be in contact with the stack of flat objects, said pad being mounted on an oscillating lever returned into position by a calibrated spring and said lever being equipped with a flag making it possible to blank off an optoelectronic cell if said flag passes through a predetermined position corresponding to a certain load applied to the pad.

4. The device according to claim 2, wherein said load measurement means (16) comprises a pad disposed in the destacker device (6,8) so as to be in contact with the stack of flat objects and a strain gauge bar on which said pad is mounted.

* * * * *